United States Patent [19]

Sandeman et al.

[11] 4,207,937

[45] Jun. 17, 1980

[54] FLEXIBLE BULK CONTAINER

[75] Inventors: Allan M. Sandeman; James D. Bell, both of Dundee, Scotland

[73] Assignee: Tay Textiles Limited, Dundee, Scotland

[21] Appl. No.: 930,783

[22] Filed: Aug. 3, 1978

[30] Foreign Application Priority Data

| | | | |
|---|---|---|---|
| Aug. 6, 1977 | [GB] | United Kingdom | 33076/77 |
| Aug. 26, 1977 | [GB] | United Kingdom | 36051/77 |
| Nov. 18, 1977 | [GB] | United Kingdom | 48179/77 |
| May 31, 1978 | [GB] | United Kingdom | 25798/78 |
| May 31, 1978 | [GB] | United Kingdom | 25799/78 |
| May 31, 1978 | [GB] | United Kingdom | 25800/78 |

[51] Int. Cl.[2] ..... B65D 33/02

[52] U.S. Cl. ..... 150/1; 150/12

[58] Field of Search ..... 150/1, 12; 139/389, 139/390

[56] References Cited

U.S. PATENT DOCUMENTS

| | | | |
|---|---|---|---|
| 1,572,605 | 2/1926 | Howe | 150/1 X |
| 1,682,198 | 8/1928 | Sitton | 139/389 |
| 1,983,452 | 12/1934 | Gwaltney | 150/1 UX |
| 2,808,091 | 10/1957 | Cumbler | 150/1 |
| 4,010,784 | 3/1977 | Nattrass | 150/12 X |
| 4,143,796 | 3/1979 | Williamson | 150/1 X |

FOREIGN PATENT DOCUMENTS 48-62246 8/1973 Japan .

*Primary Examiner*—Donald F. Norton
*Attorney, Agent, or Firm*—Neil F. Markva

[57] ABSTRACT

A flexible bulk container for carrying up to one ton of material in e.g. granular form. The container includes a bag of woven fabric such as polypropylene. Where necessary for reasons of reinforcement, i.e. where lifting loops are attached, or adjacent seams, the warp of the fabric is of increased strength per unit width. This is achieved by the use of higher tenacity warp threads, and/or a higher density of warp threads.

21 Claims, 3 Drawing Figures

FLEXIBLE BULK CONTAINER

BACKGROUND OF THE INVENTION

This invention relates to flexible bulk containers.

Such containers may be used in the storage and transport of materials in granular, powder and other particulate form, such as chemicals, foodstuffs, cement and so forth. The containers are generally in the form of large bags or sacks. They are often required to carry loads of up to one ton or more, and there should desirably be a considerable safety margin above this working load.

The containers are frequently made from woven fabric, for example woven polypropylene or another suitable synthetic material. In many instances there will be seams between adjacent portions of the container and it has been found that in use these can become regions of high stress concentration so that there is an increased tendency of the fabric to tear adjacent the seams. It is also known to attach lifting loops or the like to the main body of the container, and the points of attachment may similarly become regions of high stress concentration.

Various methods have been proposed for reinforcing a container in regions of potentially high stress concentrations, but many of these proposals involve the use of additional reinforcing material and an increased number of manufacturing steps. This may increase the time and cost of production, which can be undesirable, particularly if the containers are intended to be disposable.

SUMMARY OF THE INVENTION

According to the invention, a flexible bulk container of woven fabric has at least one region of a fabric portion in which the strength of the warp per unit width is greater than that over at least the major part of the remainder of the portion.

The higher warp strength region could for example be adjacent a seam between two fabric portions. Thus, there may be a seam along a selvedge of a fabric portion, the higher warp strength region being adjacent the selvedge.

In a construction where the fabric portion is joined to another portion of stronger material which needs no additional strength near the seam, only one fabric portion need have the higher warp strength region adjacent its selvedge. In many cases, however, there will be seams between the selvedges of portions of like fabric, and each portion will have a higher warp strength region adjacent its selvedge.

The container may be made from a plurality of fabric panels or from a single strip of fabric suitably folded, different parts of which constitute fabric portions. It is generally desirable that higher warp strength regions are provided adjacent both selvedges of a fabric panel or strip.

Advantageously, the container may be designed so that as many of its seams as possible extend along selvedges, or at least those seams which will be subjected to the highest stress concentration in use.

In a construction employing a plurality of fabric panels, which for ease of manufacture may be of constant width, the panels may be joined to one another along their selvedges to form an open top bag-like structure with the seamed selvedges extending generally vertically. One such construction may comprise three portions, one of which is U-shaped, the other two being connected across the ends of the U-shaped portion, the curved bight of which forms the bottom of the container.

Joining of fabric portions may be by any suitable means such as welding or stitching. For example, stitching may be applied as a continuous helix, each convolution penetrating the higher warp strength regions. Alternatively, parallel rows of stitching can be inserted through the higher warp strength regions.

The higher warp strength regions adjacent seams not only improve the resistance to tearing of the fabric but also provide suitably reinforced regions for lifting means, such as fabric loops, to be attached to the container. These may be stitched or otherwise fastened to the regions of higher warp strength. This may be particularly advantageous in constructions where the selvedges and hence the higher warp strength regions extend generally vertically, since the stresses of lifting the container by the loops or the like can be borne largely by these stronger regions.

Although in the container described above the higher warp strength regions adjacent seams provide suitable points of attachment for lifting means such as loops or the like, regions of higher warp strength could be provided between the selvedges, for example in the middle of a panel portion, so as to facilitate the attachment of lifting loops, straps and so on, at locations other than adjacent seams.

Such positioning of higher warp strength regions independently of seams is itself advantageous, and is applicable to a container having no suitable seams, for example, a container having a seamless main body portion.

Such a container may comprise a main body portion in the form of a seamless tube the warp threads of which are parallel to the axis of the tube, the regions of higher strength warp being spaced around the periphery of the tube, the tube being closed at one end and lifting means such as loops being fastened at the other end of the tube to the higher strength warp regions.

Lifting loops for example may be fastened to the body portion by attaching the ends of the strips of loop material to radially projecting flanges on the body portion formed by pinching together the regions of the body portion with higher warp strength, the loop ends being attached to the opposite outside faces of the pinched portions. Alternatively opposite ends of a strip of material to form a loop may be fastened to the inside and the outside surfaces of the body portion.

The body portion may be closed at the bottom end by fitting a circular bottom piece to the body portion and attaching it thereto e.g. by stitching the sides together.

The body member presents no longitudinal seams which would be weak points, and is simple to form due to the reduced number of sewing operations.

The higher strength warp regions could be provided by using a higher density of warp threads, by using higher tenacity warp threads, or by a combination of the two. Warp threads of lower tenacity may be formed as flat polypropylene tape, and those of higher tenacity as twisted polypropylene tape, R.E.F. (roll embossed film) yarns or high tenacity multi-filament yarns. In a preferred construction, while the lower tenacity threads are flat tape, the higher tenacity threads are e.g. R.E.F. polypropylene yarns or circular cross-section filaments. The two types of thread may be of different materials, for example the lower tenacity threads being of polypropylene and the higher tenacity threads of polyester or nylon.

It will be appreciated that by means of the suitable disposition of higher warp strength regions, it is possible to provide reinforcement adjacent a seam or the point of attachment of lifting means such as a loop, by means which are inherent in the production of the fabric of the container, rather than the design of the container itself. Of course, for additional strength, it is possible to combine the use of higher warp strength regions with other means of reinforcement, improved seam constructions and so forth.

Woven fabric for use in constructing the container may for example be in the form of a strip having stronger warp regions adjacent each selvedge, or elsewhere as appropriate, or for example in the form of a tube woven on a circular loom, with suitable regions of higher strength warp.

Aside from reinforcing seams or points of attachment for lifting loops or the like, the stronger warp regions may be employed to provide reinforcement along other lines of stress.

BRIEF DESCRIPTION OF DRAWINGS

Two embodiments of the invention will now be described by way of example and with reference to the accompanying drawings, in which.

DETAILED DESCRIPTION

Figure 1:
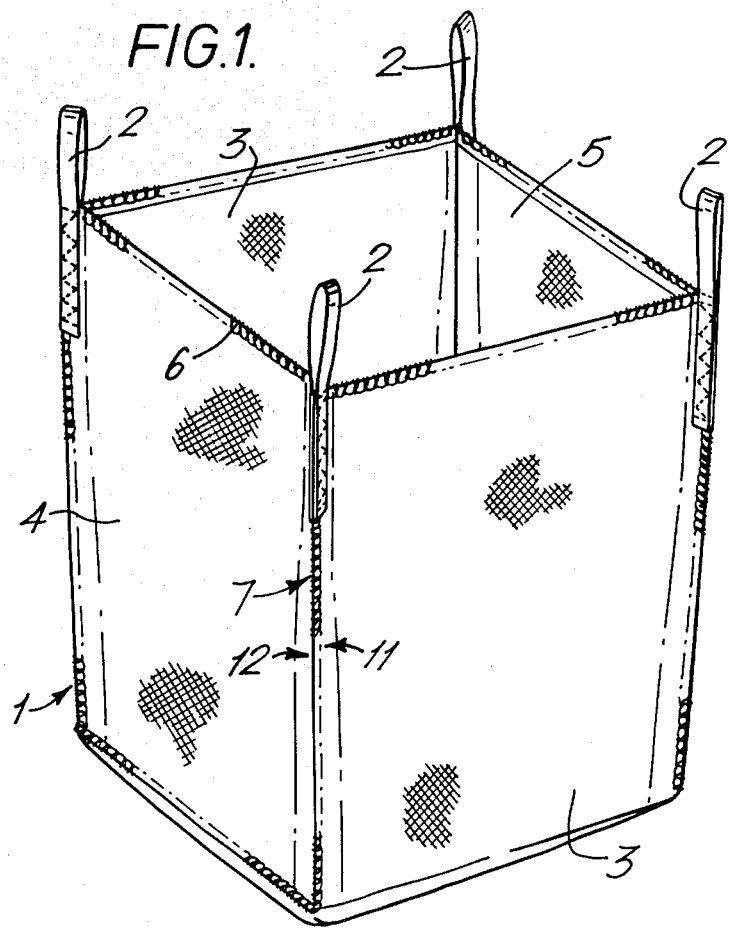
FIG. 1 is a perspective view of a container in accordance with the invention.

Referring now to the drawings, in FIG. 1 there is shown a flexible bulk container for carrying up to 1 ton of material, possibly with a safety factor of at least five times this weight. The container includes a bag portion 1, to which are attached four lifting loops 2. The bag is of woven fabric, for example, woven polypropylene, although polyethylene tetraphthalate, rayon, nylon and so forth could be used. A preferred fabric construction is 15×12 threads per inch woven polypropylene tape of 2,000 denier. The fabric may be sealed by a coating of polypropylene, or by laminated polyethylene.

The loops 2 are preferably webbing e.g. woven polyethylene tetraphthalate approximately two inches wide.

Figure 2:
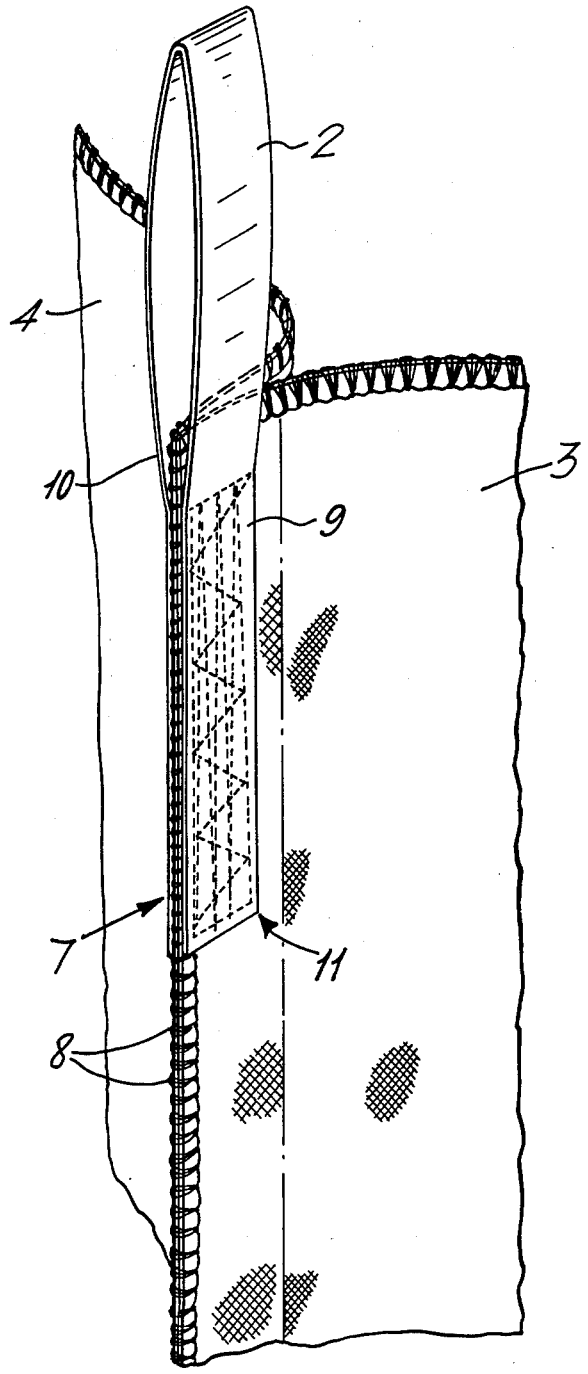
FIG. 2 is a view of part of the seam between two fabric panels in the container.

The bag 1 comprises three pieces of fabric, namely a substantially "U"-shaped portion 3, forming two sides and the base of the bag, and two rectangular pieces 4 and 5 forming the other two sides of the bag. The fabric pieces are arranged with their warp threads running vertically up the sides of the bag. The pieces are joined by stitching along seams, e.g. a blanket stitch using polypropylene yarn. The selvedges of the fabric pieces 3, 4 and 5 run vertically along the seams, apart from at the base of the bag. Stitching 6 is provided around the top of the bag, to prevent fraying of the fabric. The seam construction and method of attachment of the loops to the bag is shown more clearly in FIG. 2. The two pieces of fabric 3 and 4 are stitched together along seam 7, by polypropylene yarn 8.

The loop 2 has two legs 9 and 10. The fabric adjacent the seam 7 is pinched together, to form a flange, and the legs 9 and 10 are stitched to the flange, straddling it. Each stitch passes through the legs 9 and 10 of the loop and the two thicknesses of bag fabric.

Although not shown, adjacent the selvedge of the fabric pieces the weft threads are turned back, for example a distance of ½ inch. This can provide a degree of reinforcement adjacent the seam. Additionally however, and in accordance with the invention, strengthening is obtained by means of a higher strength density of warp threads. For example, in regions generally marked 11 and 12, adjacent the selvedge of fabric pieces 3 and 4 respectively, there is a higher density of warp threads, i.e. the threads are packed closer together, and/or warp threads of higher tenacity. Thus, over the majority of the bag, the warp threads could be polypropylene tape having a tenacity of perhaps 4 to 6 g/denier. In regions such as 11 and 12, adjacent selvedges, the warp threads could be polypropylene R.E.F. yarns having a tenacity of 5–7 g/denier or multi-filament polypropylene yarns. The widths of the regions 11 and 12 are such as to accommodate the legs of the loop, and they run the length of the selvedges.

Figure 3:
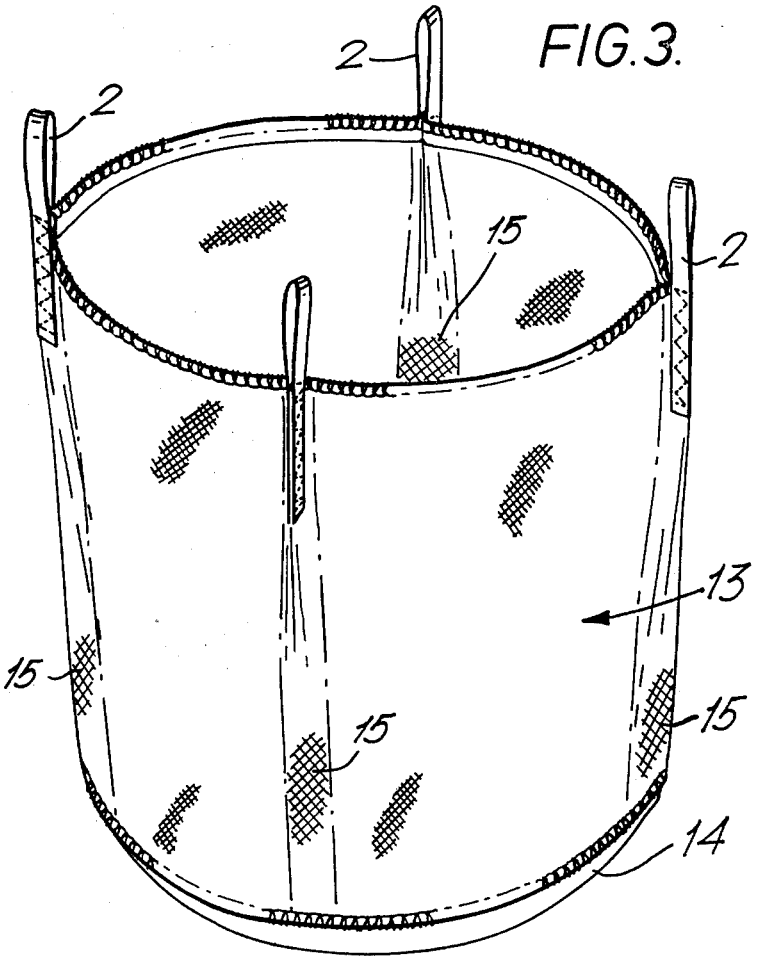
FIG. 3 is a perspective view of a second embodiment of a container in accordance with the invention.

In FIG. 3, there is shown another embodiment of the invention, in which the container comprises a one-piece, tubular main body portion 13, to which is stitched a circular base 14. Four loops 2 are attached to the top of the bag, spaced equidistantly around it. At the point of attachment of a loop 2, the bag fabric is pinched to form a flange adjacent the top of the bag. The legs of the loop straddle the flange and are stitched thereto as in the previous embodiment.

The points of attachment of the loops 2 are in regions 15 of higher strength density warp threads, the warp threads extending vertically up the bag. The higher strength density may be obtained as described earlier. In other respects, for example regarding the materials used, the bag is similar in construction to those described earlier.

It will thus be seen that there is provided a container which, while simple in construction, has improved strength and reliability, and in which lifting stresses, when the container is lifted by the loops, are transmitted down the container by reinforced regions. The method by which the fabric of the bag is manufactured, and the bag is constructed, allow for greater productivity.

We have found that a particularly advantageous arrangement combines the use of R.E.F. yarns with a "cramming" effect, in the regions adjacent the selvedges. Thus R.E.F. polypropylene warp yarns are woven in pairs; to assist in the weaving process it is then advantageous for the warp yarns to pass over and under two weft threads at a time. The resultant container has a considerably improved strength, and is capable of carrying up to between 8 and 10 tons.

We claim:

1. A flexible bulk container comprising:

(a) a bag portion of woven fabric having side walls and a closed bottom, (b) flanges of at least double thickness formed from the side walls and extending downwardly from the upper end of the side walls, (c) lifting means being attached to the flanges at the upper end of the side walls, (d) the warp threads of the fabric constituting the side walls extending in the vertical direction, and (e) the strength of the warp per unit width in the region of attachment of the lifting means along each said flange being greater than that over at least the major part of the remainder of the side walls.

2. A container according to claim 1, wherein the region of attachment of the lifting means is adjacent a joint between two fabric portions constituting the side walls, the joint extending along the selvedges of the two portions, and the strength of the warp per unit width being increased in regions adjacent the respective selvedges.

3. A container according to claim 1, wherein the side walls are defined by a tubular fabric portion, and a plurality of lifting means are attached to the tubular portion at regions spaced around the periphery thereof, these regions each being a region of increased warp strength per unit width.

4. A container according to claim 1, wherein the warp threads in the said region of attachment of the lifting means are of a higher tenacity than elsewhere.

5. A container according to claim 1, wherein the warp threads in the said region of attachment of the lifting means are more closely packed together than elsewhere.

6. A container according to claim 1, wherein the width of the fabric region in which the warp strength per unit width is increased, is sufficient to accommodate the width of lifting means attached to the side walls.

7. A flexible bulk container of woven fabric, said container comprising:

(a) side walls and a closed bottom, (b) the warp threads of the fabric constituting the side walls extending up the bag, (c) a joint formed along two fabric portions constituting the side walls and adjacent the selvedges thereof, said joint extending downwardly from the upper end of the side walls, (d) the strength of the warp per unit width in regions adjacent to and terminating at the respective selvedges being greater than that over at least the major part of the remainder of the portions, and (e) lifting means being attached to the side walls in said regions of said joint at the upper ends of said side walls.

8. A container according to claim 7 wherein the greater strength warp regions adjacent said joint define a flange of at least double thickness material extending from the side walls, the lifting means being attached to said flange.

9. A container according to claim 7 wherein the bag consists of three woven fabric portions including U-shaped portion to form first and second side walls and the base of the bag, and two remaining portions connected across the ends of the U-shaped portion to form third and fourth side walls, said greater strength warp regions extending along each of said three portions adjacent both selvedges thereof.

10. A container according to claim 7 wherein the threads in the regions of greater warp strength are of a higher tenacity than elsewhere.

11. A container according to claim 7 wherein the warp threads in the regions of greater warp strength are more closely packed together than elsewhere.

12. A container according to claim 7 wherein the fabric is woven polypropylene, and the warp threads in the regions of greater warp strength are in the form of roll embossed film yarns.

13. A container according to claim 7 wherein each region of greater warp strength is sufficiently wide to accommodate the width of lifting means attached to the side walls.

14. A flexible bulk container comprising:

(a) a bag of woven fabric having side walls and a closed bottom, (b) the warp threads of the fabric constituting the side walls extending up the bag and including regions in which the strength of the warp per unit width is greater than that over at least the major part of the remainder of the side walls, (c) flanges of at least double thickness material being formed in said regions and extending from the side walls, and (d) lifting means are attached to said flanges adjacent the upper ends thereof, the width of said greater warp regions and said flanges being sufficient to accommodate said lifting means, (e) each lifting means comprises a loop having two legs, (f) the legs straddling a respective flange and being connected thereto by stitching passing through both said legs and the flange.

15. A container according to claim 14 wherein said greater strength warp regions each comprise a pair of such regions adjacent to and terminating at the selvedges of respective fabric portions joined together and forming said side walls.

16. A container according to claim 14 wherein said flanges are formed by outwardly pinched regions in a continuous fabric portion.

17. A flexible bulk container comprising:

(a) a bag consisting of three woven fabric portions including a substantially U-shaped portion defining first and second side walls and the base of the bag, and two remaining portions connected across the ends of the U-shaped portion and defining third and fourth side walls, (b) warp threads of the substantially U-shaped portion extending up the first and second side walls and across the base, (c) warp threads of the two remaining portions extending up the third and fourth side walls, (d) each of said portions including regions extending the length thereof in which the strength of the warp per unit width is greater than that over at least the major part of the remainder of the respective portion, and (e) lifting means attached to said regions adjacent the upper end of the bag.

18. A container according to claim 17 wherein each of said portions includes a pair of said greater warp strength regions, on opposite sides thereof.

19. A container according to claim 18 wherein the greater strength warp regions are adjacent to and terminate at the selvedges of the respective fabric portions.

20. A container according to claim 19 wherein the lifting means are attached at the four corners of the bag adjacent the joints between the respective fabric portions.

21. A container according to claim 20 wherein each lifting means comprises a loop having two legs which straddle a flange formed at the joint between respective fabric portions, stitching passing through both legs and both fabric portions.

* * * * *